US007999747B1

(12) United States Patent
Wedding et al.

(10) Patent No.: US 7,999,747 B1
(45) **Date of Patent: *Aug. 16, 2011**

(54) GAS PLASMA MICRODISCHARGE ANTENNA

(75) Inventors: Carol Ann Wedding, Toledo, OH (US); Thomas J. Pavliscak, Palos Verdes, CA (US); Edwin F. Peters, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 502 days.

This patent is subject to a terminal disclaimer.

(21) Appl. No.: 12/120,742

(22) Filed: May 15, 2008

Related U.S. Application Data

(60) Provisional application No. 60/938,037, filed on May 15, 2007.

(51) Int. Cl.
*H01Q 1/26* (2006.01)
*H01Q 15/02* (2006.01)

(52) U.S. Cl. ..... 343/701; 343/754; 343/909

(58) Field of Classification Search ..... 343/701, 343/700 MS, 834, 754, 909, 795, 840
See application file for complete search history.

(56) References Cited

U.S. PATENT DOCUMENTS 3,515,932 A 6/1970 King
3,914,766 A 10/1975 Moore
4,260,994 A 4/1981 Parker
4,684,952 A * 8/1987 Munson et al. ..... 343/700 MS
4,905,014 A 2/1990 Gonzalez et al.
4,977,352 A 12/1990 Williamson
5,182,496 A 1/1993 Manheimer et al.
5,323,169 A 6/1994 Koslover
5,418,431 A 5/1995 Williamson et al.
5,594,456 A 1/1997 Norris et al.
5,832,072 A 11/1998 Rozenblit
5,846,883 A 12/1998 Moslehi
5,864,322 A 1/1999 Pollon et al.
5,952,980 A 9/1999 Boling
5,963,169 A 10/1999 Anderson et al.
5,982,334 A 11/1999 Manasson et al.
5,990,837 A 11/1999 Norris et al.
6,028,324 A 2/2000 Su et al.
6,046,705 A 4/2000 Anderson
6,087,992 A 7/2000 Anderson
6,087,993 A 7/2000 Anderson et al.
6,118,407 A 9/2000 Anderson
6,164,241 A 12/2000 Chen et al.
6,169,520 B1 1/2001 Anderson
6,271,810 B1 8/2001 Yoo et al.
6,316,777 B1 11/2001 Parrish et al.
6,369,763 B1 4/2002 Norris et al.
6,417,807 B1 * 7/2002 Hsu et al. ..... 343/700 MS
6,492,951 B1 12/2002 Harris et al.
6,512,496 B2 1/2003 Alexeff et al.
6,540,180 B2 4/2003 Anderson
6,567,046 B2 * 5/2003 Taylor et al. ..... 343/700 MS
6,624,719 B1 9/2003 Anderson et al.
6,650,297 B2 11/2003 Anderson et al.
6,657,594 B2 12/2003 Anderson
6,674,970 B1 1/2004 Anderson (Continued)

*Primary Examiner* — Michael C Wimer
(74) *Attorney, Agent, or Firm* — Donald K. Wedding

(57) ABSTRACT

A gas plasma antenna with a rigid, flexible, or semi-flexible substrate and an improved method of generating a uniform electron density. The antenna comprises a gas discharge device containing a multiplicity of microcavities, each microcavity containing an ionizable gas for providing a microdischarge. Each microdischarge acts alone or in concert with other microdischarges to form a dipole or pattern of dipoles.

10 Claims, 14 Drawing Sheets

U.S. PATENT DOCUMENTS 6,677,913 B2 1/2004 Engargiola et al.
6,700,544 B2 3/2004 Anderson
6,710,746 B1 3/2004 Anderson et al.
6,806,833 B2 10/2004 Anderson
6,812,895 B2 11/2004 Anderson et al.
6,825,814 B2 11/2004 Hayes
6,842,146 B2 1/2005 Alexeff et al.
6,843,178 B2 1/2005 Wood et al.
6,856,301 B2 2/2005 Walker et al.
6,870,517 B1 3/2005 Anderson
6,876,330 B2 4/2005 Anderson et al.
6,879,289 B2 4/2005 Hayes
6,922,173 B2 7/2005 Anderson
6,952,189 B2 10/2005 Engargiola et al.
7,068,226 B1 6/2006 Mitra
7,109,124 B2 9/2006 Harper
7,145,512 B2 12/2006 Metz
7,225,740 B1 6/2007 Wood et al.
7,262,734 B2 8/2007 Wood
7,274,333 B1 9/2007 Alexeff
7,292,191 B2 11/2007 Anderson
7,340,025 B2 3/2008 Melin et al.
7,342,549 B2 3/2008 Anderson
7,367,281 B2 5/2008 Lee
7,719,471 B1 * 5/2010 Pavliscak et al. ..... 343/701
2001/0033207 A1 10/2001 Anderson et al.
2002/0093460 A1 7/2002 Alexeff et al.
2003/0142021 A1 7/2003 Anderson
2003/0146879 A1 8/2003 Anderson
2003/0160724 A1 8/2003 Alexeff et al.
2003/0193435 A1 10/2003 Anderson et al.
2003/0193436 A1 10/2003 Anderson
2004/0041741 A1 3/2004 Hayes
2004/0061650 A1 4/2004 Anderson et al.
2004/0130497 A1 7/2004 Alexeff et al.
2004/0227682 A1 11/2004 Anderson
2005/0057432 A1 3/2005 Anderson
2005/0084996 A1 4/2005 Harper
2005/0110691 A1 5/2005 Anderson
2005/0183668 A1 8/2005 Lee
2005/0280372 A1 12/2005 Anderson
2006/0220980 A1 10/2006 Metz
2007/0044674 A1 3/2007 Wood
2007/0163500 A1 7/2007 Kim et al.
2007/0263759 A1 11/2007 Melin et al.
2007/0285022 A1 12/2007 Anderson

* cited by examiner $L_v$ = DIPOLE LENGTH – VERTICAL POL
$L_h$ = DIPOLE LENGTH – HORIZONTAL POL
T = DIPOLE THICKNESS
$\epsilon$ = DIELECTRIC CONSTANT

GAS PLASMA MICRODISCHARGE ANTENNA

RELATED APPLICATION

This application claims priority under 35 U.S.C. 119(e) from U.S. Provisional Application Ser. No. 60/938,037, filed May 15, 2007.

FIELD OF INVENTION

This invention relates to an open cell or closed cell AC or DC microdischarge plasma antenna having a multiplicity of microcavity gas discharge cells and an integrated backplane of active components. This invention relates to phased array antennas, including dynamic gas plasma driven phased array antennas. The antenna comprises one or more microcavities on or within a rigid, flexible, or semi-flexible substrate with each microcavity containing an ionizable gas and being electrically connected to at least two electrical conductors such as electrodes. This invention particularly relates to a microdischarge structure having at least one active component provided for each microcavity cell. In one embodiment, the microdischarge is operated at high frequency. In one embodiment there is provided a closed cell microdischarge with an open drain, low capacitance IC output in series with each single microdischarge cell and a high voltage common AC or DC driving source. With AC mode operation each closed cell microdischarge pixel has at least one of its electrodes enclosed within a dielectric barrier. When the IC output is ON, all the AC voltage from the source is seen across the individual microdischarge cell which has enough amplitude to quickly turn ON (ionize) the microdischarge cell. When the output is OFF, the combination of microdischarge cell capacitance in series with the OFF open drain capacitance is such that most of the source voltage appears across the open drain output, and therefore, the microdischarge cell turns off. In one embodiment, the microdischarge cells are AC devices and can be driven with high frequency and high voltage excitation. In another embodiment, there is provided a DC microdischarge. In such embodiment, there is provided a DC microdischarge using an open drain, low capacitance, current limited IC output in series with each microdischarge cell and a high voltage common DC driving source

INTRODUCTION

Phased array antennas are known in the prior art, for example, as disclosed in U.S. Pat. No. 4,905,014 (Gonzalez et al). In general, a microwave phasing structure includes a support matrix, i.e., a dielectric substrate, and a reflective means, i.e., a ground plane, for reflecting microwaves within the frequency-operating band. The reflective means is supported by a support matrix. An arrangement of electromagnetically loading structures is supported by the support matrix at a distance from the reflective means, which can be less than a fraction of the wavelength of the highest frequency in the operating frequency range. The electromagnetically loading structures are dimensioned, oriented, and interspaced from each other and disposed at a distance from the reflective means, as to provide the emulation of the desired reflective surface of selected geometry. Specifically, the electromagnetically-loading structures form an array of metallic patterns, each metallic pattern preferably being in the form of a cross, i.e., X configuration. It is disclosed that each electromagnetically-loading structure can be constructed to form different geometrical patterns and, in fact, could be shorted crossed dipoles, metallic plates, irises, apertures, etc. It is further disclosed that the microwave phasing structures of Gonzalez et al. (014) patent may be used for electromagnetically emulating a desired microwave-focusing element of a selected geometry.

The selected geometry of the desired reflective surface can be a parabolic surface in order to emulate a parabolic reflector wherein all path lengths of the reflected incident electromagnetic waves are equalized by phase shifting affected by the microwave phasing structure of the present invention. While the microwave phasing structure may emulate desired reflective surfaces of selected geometries such as a parabola, the microwave phasing structure is generally flat in shape. However, the shape of the microwave phasing structure may be conformal to allow for mounting on substantially non-flat surfaces.

RELATED PRIOR ART RADIATION DETECTORS

Radiation detectors are well known in the prior art including gas-filled detectors. The following prior art relates to radiation detectors. and is incorporated herein by reference: U.S. Pat. Nos. 3,110,835 (Richter et al.), 4,201,692 (Christophorou et al.), 4,309,309 (Christophorou et al.), 4,553,062 (Ballon et al.), 4,855,889 (Blanchot et al.), 5,905,262 (Spanswick), U.S. Patent Application Publication 2004/0027269 (Howard), and WO 98/28635 (Koster et al.), all incorporated herein by reference.

RELATED PRIOR ART Methods of Producing Microdischarge Cell Display

U.S. Pat. Nos. 7,098,420 (Crowe et al.), 7,025,646 (Geusic), 6,998,787 (Geusic), 6,657,370 (Geusic), 6,541,915 (Eden et al.), U.S. Patent Application Publication 2006/0039844 (Gutson et al.), and U.S. Patent Application Publication 2006/0038490 (Eden et al.), relate to microdischarge cell displays and are incorporated herein by reference. The following microdischarge cell patents disclose a sealed light-transmissive cap that seals the microdischarge cavity. U.S. Pat. Nos. 6,194,833 (DeTemple et al.), 6,139,384 (DeTemple et al.), and 6,016,027 (DeTemple et al.), all incorporated herein by reference. The following microdischarge patents and patent applications that disclose encapsulated electrodes are incorporated herein by reference. include U.S. Pat. Nos. 6,867,548 (Eden et al.), 6,828,730 (Eden et al.), 6,815,891 (Eden et al.), 6,695,664 (Eden et al.), 563,257 (Vojak et al.), U.S. Patent Application Publication Nos. 2006/0082319 (Eden et al.), 2006/0071598 (Eden et al.), 2006/0012277 (Park et al.), 2005/0269953 (Eden et al.), 2005/0171421 (Eden et al.), 2005/0148270 (Eden et al.), 2004/0160162 (Eden et al.), 2004/0100194 (Eden et al.), 2003/0132693 (Eden et al.), 2003/0080688 (Eden et al.), 2003/0080664 (Eden et al.), and 2002/0113553 (Vojak et al.), all incorporated herein by reference.

RELATED PRIOR ART BACKPLANE

Examples of active backplane applications are found in U.S. Pat. Nos. 7,019,795 (Jones), 7,061,463 (Crossland et al.), and 6,812,909 (Crossland), all incorporated herein by reference.

THE INVENTION

In accordance with this invention, there is provided a microdischarge cell antenna device comprised of a multiplicity of microcavity cells and an integrated active backplane with active components such as transistors, each microcavity cell being formed and integrated in series with an active component. The microdischarge antenna device may be AC or DC gas discharge.

In accordance with this invention, there is provided an improved microdischarge device having a multiplicity of microcavity cells, each microcavity cell being electrically contacted with an integrated active component such as a transistor.

In addition to the transistor connected at each microcavity discharge cell, there may be other advantageous active components such as high speed shift register and/or addressing logic, and control circuitry so as to bring control signals to all the driver transistors with a much reduced pin count interface. In one embodiment, the microcavity and active components are made from the same substrate such as the same silicon wafer. Other substrate materials for making the microcavity and active backplane include germanium and other semiconductor wafer materials.

In one embodiment, there is provided at least one AC microdischarge antenna structure with a multiplicity of microcavity cells and an integrated backplane of active components, at least two electrodes being in electrical contact with each cell, and at least one electrode being encapsulated with a dielectric. In an AC device all electrodes connected to each cell are typically encapsulated with dielectric. In such embodiment, an active component is provided for each cell of the AC microdischarge antenna device. Typically this active component is a field effect transistor (FET). In one embodiment, it is an open drain FET.

In accordance with another embodiment of this invention, there is provided a DC microdischarge device with a multiplicity of microcavity cells and a backplane of active components. In a DC device, the electrodes are not encapsulated with a dielectric. At least one active component is provided for each cell. The active component may be a bipolar transistor. In one embodiment, it is an open collector bipolar transistor. The active component may also be a field effect transistor (FET). In one embodiment, it is an open drain FET.

In accordance with this invention, there is provided an improved microdischarge antenna device that eliminates limitations and disadvantages associated with the manufacture and performance of prior art antenna structures.

In one embodiment of this invention, there is provided an improved microdischarge device with a multiplicity of microcavity cells, with each microcavity cell in a silicon substrate that contains a conductive medium such as gas or vapor, wherein the medium is electrically connected to at least one active component such as a transistor formed in the silicon with the microcavity.

In another embodiment of the invention there is provided an improved DC microdischarge device comprising a multiplicity of microcavity cells penetrating a dielectric and a planar metallized (or semiconductor) anode, and extending from a planar semiconductor cathode, each microcavity containing a conductive filler, such as gas or vapor, with the filler electrically contacted by the semiconductor cathode.

Another embodiment of the invention provides an improved DC microdischarge antenna device including a multiplicity of microcavity cells in a silicon substrate (or silicon film on an insulating substrate such as glass) which contains a conductive filler, the filler being electrically contacted by one or more semiconductor electrodes formed in the silicon, wherein the device is operable as a hollow cathode discharge at a pd product (pressure×diameter) exceeding approximately 20 Torr-mm, depending on the selected ratio of the cavity length to the cavity aperture.

In another embodiment of this invention, there is provided a microdischarge antenna device with an array of microcavity cells in which the microcavity extends through the substrate and electrodes are fabricated on opposite sides of the substrate, allowing gases or vapors to flow through the microdischarge cavities, such that the gases can be decomposed into a less hazardous form or converted into a more useful species.

DC microdischarge antenna devices having a microcavity enclosing a discharge medium (gas or vapor) excited through electrical contact with a surrounding or planar substrate cathode have been produced. Hollow cathode geometries are achieved by having the microcavity penetrate the semiconductor cathode. The semiconductor electrode may also serve as a planar electrode from which the microcavity or a microchannel extends through a dielectric and planar anode.

Selection of a sufficient aperture to length ratio for the hollow cathode geometry cavity permits the device to be operated as a hollow cathode discharge a pd (pressure times discharge distance) exceeding about 20 Torr-mm. If the cathode is selected to be cylindrical in cross-section, the small diameter offered by this device, on the order of about a single micrometer to about 400 μm, enables the discharge to be operated at pressures beyond one atmosphere. In addition, the small dimensions permit efficient production in a discharge of resonance radiation, such as the 254 nm line of atomic mercury, because the device size can now be made comparable to or less than the mean distance for the absorption of a resonant photon by a ground state atom.

The planar electrode geometry of the invention is also well suited to the discharge array arrangement. In another embodiment, arrays of micro channels are formed through VLSI fabrication techniques on a planar silicon electrode to produce pulsed or continuous emission from atomic rare gases and transient molecules, such as the rare gas-halide excimer xenon-monoiodide (XeI). The planar geometry includes a dielectric film to form the microcavities, preferably in the form of microchannels, and a conducting film on the dielectric serves as the anode. Microcavity holes or channels are formed through the conducting film and anode layers through standard VLSI fabrication techniques, e.g., photolithography, plasma, and wet etching, etc., so that the underlying semiconductor cathode is exposed.

The plasma microdischarge antenna device can accommodate a flexible back plane structure because it is possible to connect to the microdischarge cells through the back plane and because the cells allow simple interconnect.

A microdischarge antenna device may be manufactured by etching tiny wells into a silicon substrate. Because the substrate is small and made of silicon it is an ideal location to put an array of active components such as transistors.

DETAILED DESCRIPTION OF THE DRAWINGS

Figure 1:
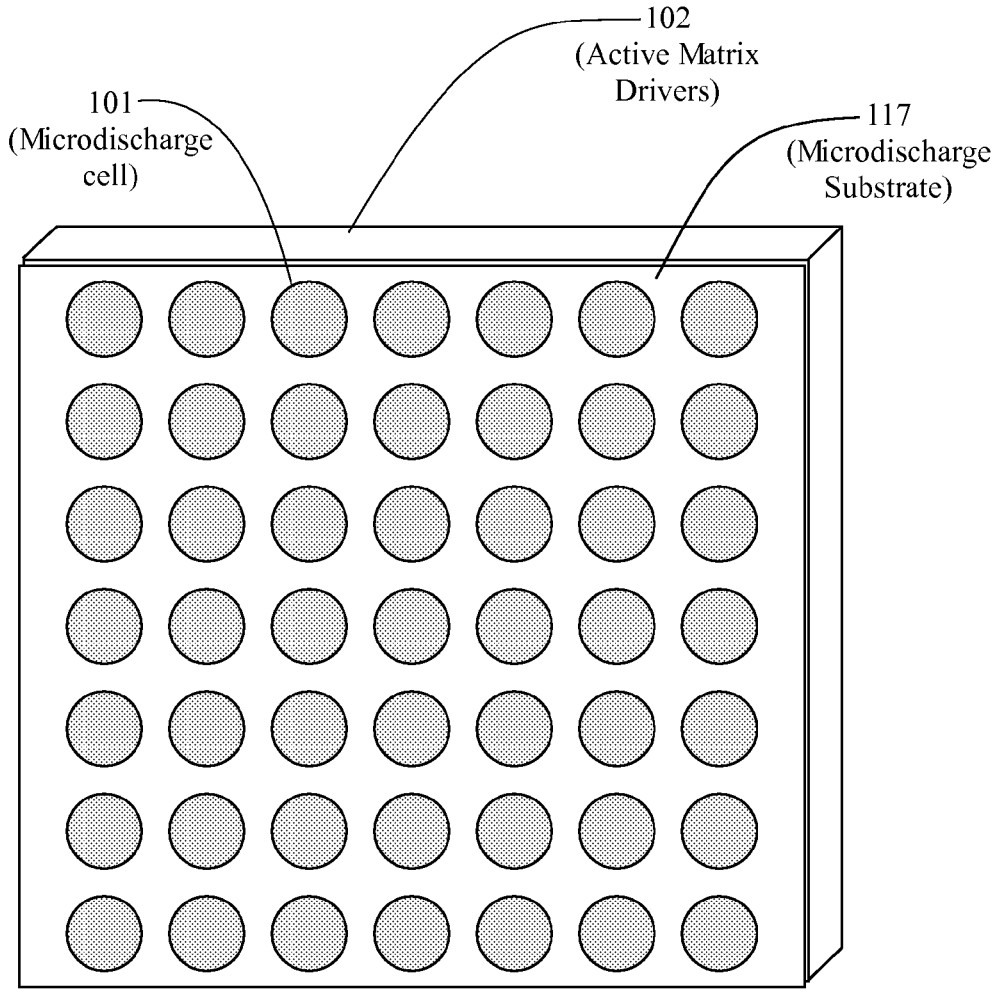
FIG. 1 is a front view of a microdischarge antenna device with an active backplane containing at least one active electronic driver device per pixel element.

FIG. 1 is a front view of a microdischarge antenna device with an active backplane containing at least one active electronic driver device per pixel element. Microdischarge cells 101 are contained on one side of microdischarge substrate 117 and active matrix driver circuits 102 are contained on the other side.

Figure 2:
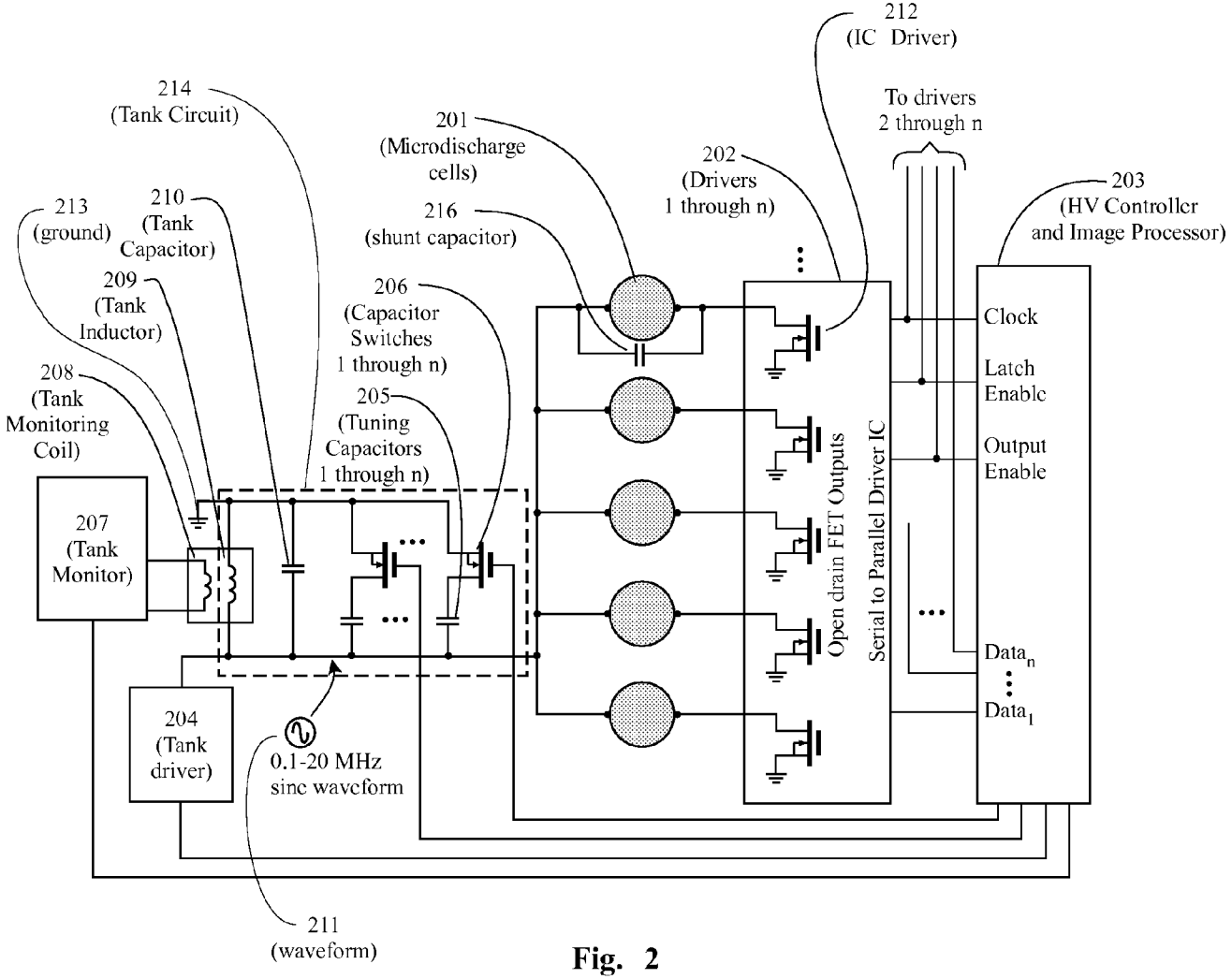
FIG. 2 is a schematic of an AC microdischarge antenna device containing an active backplane containing at least one active electronic driver device per pixel element.

FIG. 2 is a schematic of an AC embodiment of a microdischarge antenna device containing an active backplane containing at least one active electronic driver device per pixel element. In this embodiment electrodes in the microdischarge cells are not in direct contact with the ionizing gas but rather isolated from it by a layer of dielectric material.

FIG. 2 is a schematic of one embodiment of a microdischarge array driver circuit providing microsecond-by-microsecond control of over the discharge of each microdischarge cell. This level of control may provide a high-frequency sustain of 1 MHz or greater so as to provide a continuous plasma discharge and the presence of free electrons.

Microdischarge cells 201 are driven by a plurality of open drain FET circuits that individually control the operation of each microdischarge cell. A high voltage sine waveform 211, triangle, or sloped square wave of from about 0.1 to 5 MHz (that exceeds the microdischarge on voltage) is applied to one electrode of all the microdischarge cells 201. Another electrode of each microdischarge cell 201 is attached to a high voltage transistor array 202 outputs. The outputs 202 are most advantageously an open drain output type so that there are little or no switching losses when the ON/OFF state of the integrated transistors is changed. The sine or triangle waveform 211 has a direct or indirect reference to ground 213. The high voltage transistor array 212 reference is directly or indirectly connected to ground 213 to complete a current path for all microdischarge cells 201. A single or multiple transistor array, also known as a tank driver 204 drives the high voltage buss waveform 211 of all microdischarge cells. If an LC tank circuit 214 is utilized, the transistor circuit 204 adds energy to the high voltage/frequency 214 circuit in a most efficient way via zero voltage switching techniques. If the driver IC output 202 attached to a particular microdischarge cell is on, the full peak-to-peak high voltage waveform 211 is applied across that microdischarge cell 201 and if the voltage is high enough the microdischarge cell 201 will be on/discharging and producing radiation of various wavelengths. If the open drain output 202 is off, the series current will be greatly reduced, the voltage across the driver IC output will be increased, the voltage across the microdischarge cell will be decreased relative to its shunt capacitance and the light from the microdischarge cell will be greatly reduced or terminated relative to the voltage vs. discharge characteristic of the microdischarge cell 201. Driver IC 202 ON/OFF output states are most advantageously changed at a particular phase relative to the high voltage waveform 211 when the voltage across the IC 202 output is minimal. In an LC Tank drive system the phase of the sine wave is feed back to the image controller 203 so that the driver IC's output 202 is synchronized to the high voltage waveform 211. As more or less driver outputs are on during any sub-field the apparent capacitance of the main LC Tank circuit 214 is changed with an associated frequency shift. Therefore the controller 203 may switch in and out compensating parallel capacitors as needed on a predictive look-up table and/or frequency-monitoring basis. Driver chips 212 should have high voltage and low capacitance outputs. Low output impedance is ideal, but not as critical as high voltage and low capacitance. The driver output device 202 should be a FET with no series diode because it must conduct in both directions when the microdischarge cell is ON. Shunt capacitance 216 across each microdischarge cell should be enough to guarantee that the microdischarge cell will turn off when the driver chip 202 turns off. Since the driver IC's 212 are most likely referenced to ground the high excitation voltage 211 should be symmetrically positive and negative about ground to reduce the maximum voltage across the microdischarge cells. Otherwise, if the high voltage drive circuits 204, 205, 206, 207, 208, 209, 210 could also be ground referenced a component cost reduction could be realized.

Figure 3:
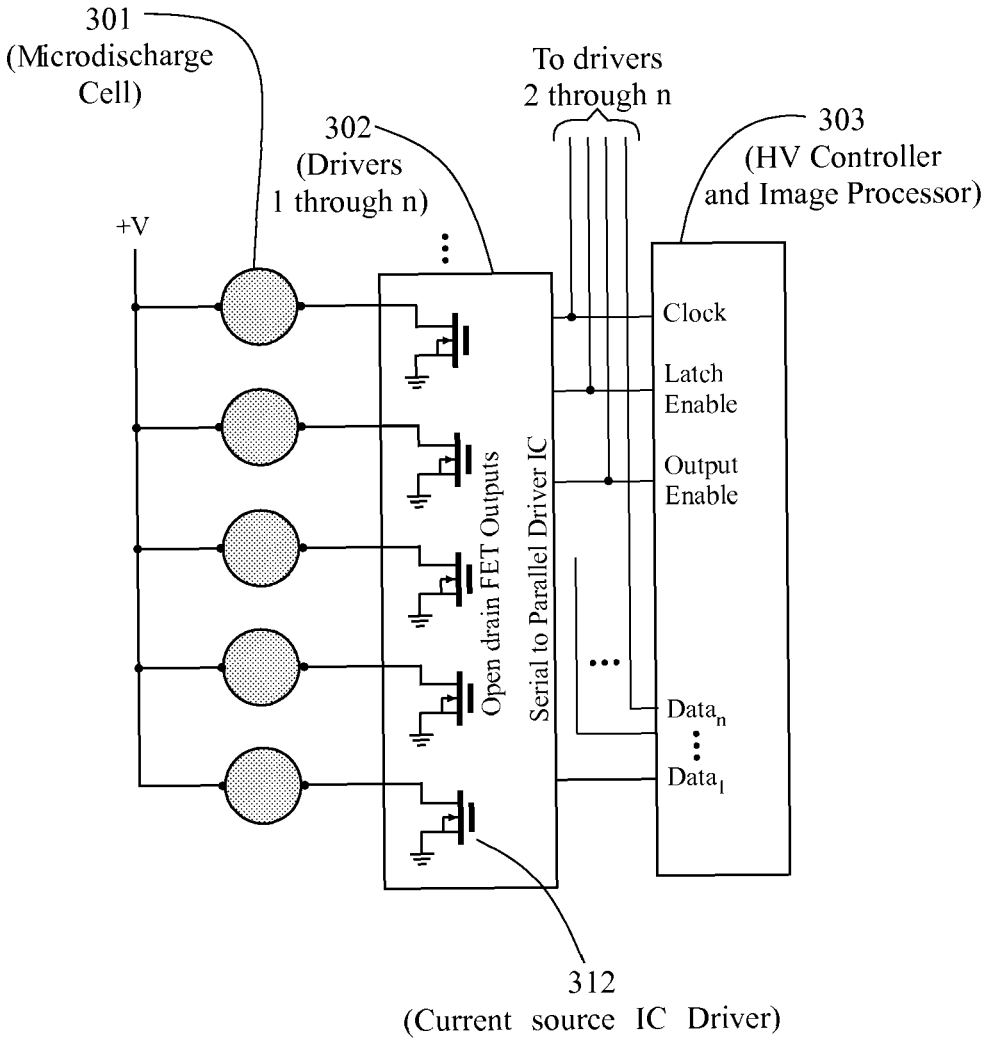
FIG. 3 is a schematic of one embodiment of a microdischarge antenna device layout with an active backplane containing at least one active electronic driver device per pixel element.

FIG. 3 is a schematic of the DC microdischarge array driver circuit providing high-speed control of the discharge of each microdischarge cell. Microdischarge cells 301 are driven by circuit driver 302 that contains a plurality of open drain, current limited, FET circuits 312 that provide appropriate voltage waveforms individually to each plasma microcavity in response to HV controller and image processor 303.

Figure 4:
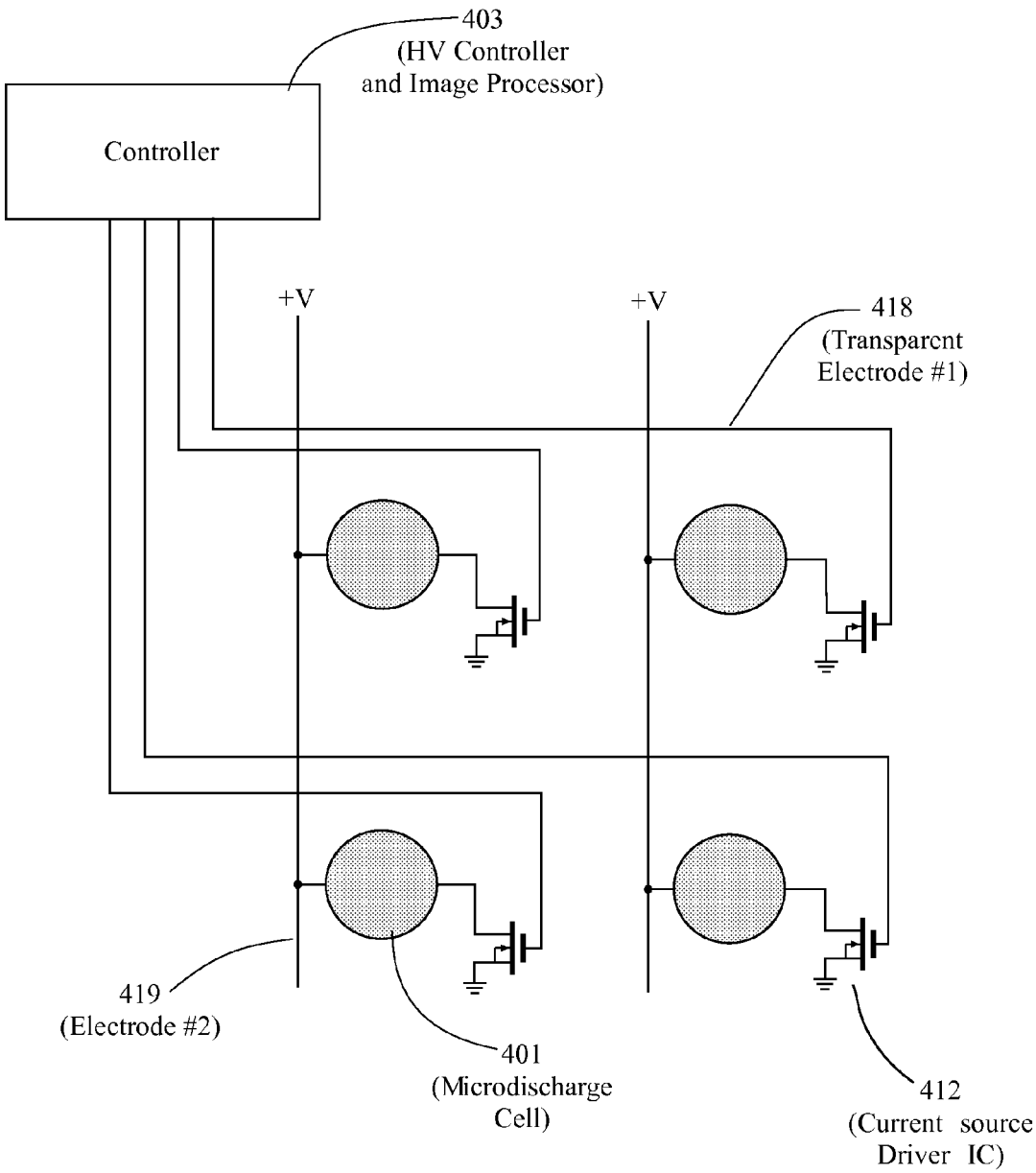
FIG. 4 is a schematic of one embodiment of a microdischarge antenna device layout with an active backplane containing at least one active electronic driver device per pixel element.

FIG. 4 is a schematic of one embodiment of a DC microdischarge antenna device layout with an active backplane containing at least one active electronic driver device per pixel element. One electrode of each microdischarge cell 401 is connected to electrode 419 having +V voltage. The other microdischarge electrode 418 is driven by an open drain, current limited, FET driver IC 412 in response to commands provided by HV controller and processor 403.

Figure 5:
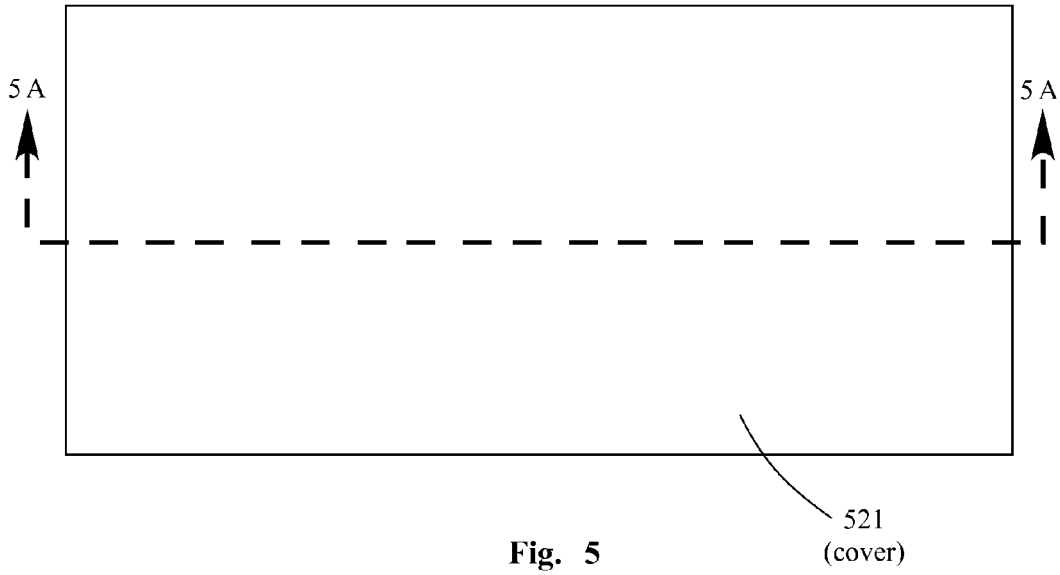
FIG. 5 is a front view of a closed cell structure microdischarge antenna device with a transparent cover and seal.

FIG. 5 is a front view of a closed cell structure microdischarge antenna device with a cover 521.

Figure 5A:
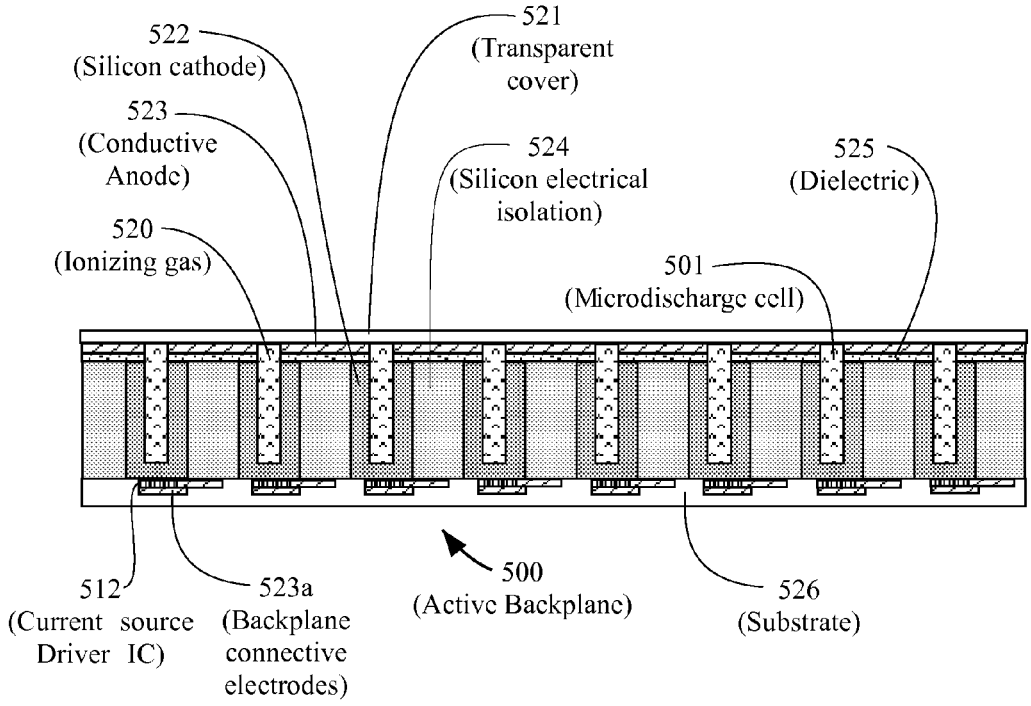
FIG. 5A is a Section 5A-5A View of a closed cell structure microdischarge antenna device built on a silicon substrate containing an active backplane.

FIG. 5A is a Section 5A-5A View of a closed cell structure microdischarge antenna device built on a silicon substrate 526 containing an active backplane 500. A matrix of electrically isolated conductive hollow silicon cathodes cells 522 are contained within an electrically isolating silicon 524, and isolated from conductive anodes 523 by dielectric layer 525. The hollow cavities in the silicon substrate 526 are covered and sealed by transparent cover 521 which seals the silicon cathodes 522 so as to form a matrix of closed microdischarge cavities containing mixtures of ionizing gas 520. An active matrix of electrical driver circuits 512 on the reverse side of the substrate 526 make contact with a conductive portion of the each microdischarge cathode 523, and are connected to backplane connective electrodes 523*a*. Electrodes 523*a* are, in turn, connected to appropriate voltage and control as illustrated in schematics.

Figure 6:
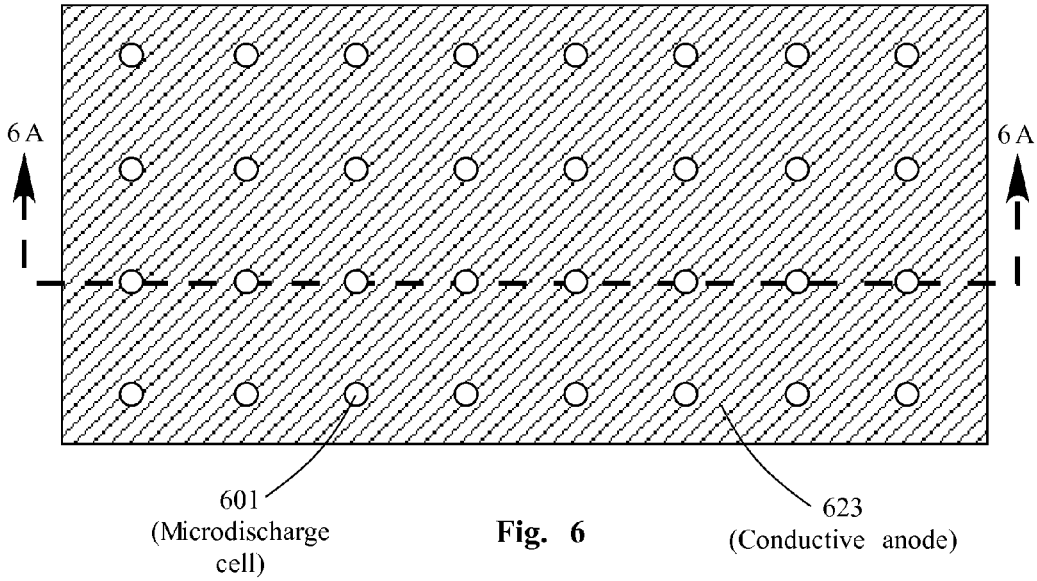
FIG. 6 is a front view of an open cell structure microdischarge antenna device with a transparent cover removed.

FIG. 6 is a front view of an open cell structure microdischarge antenna device with a transparent cover and seal removed revealing a conductive anode 623 and microdischarge cells 601.

Figure 6A:
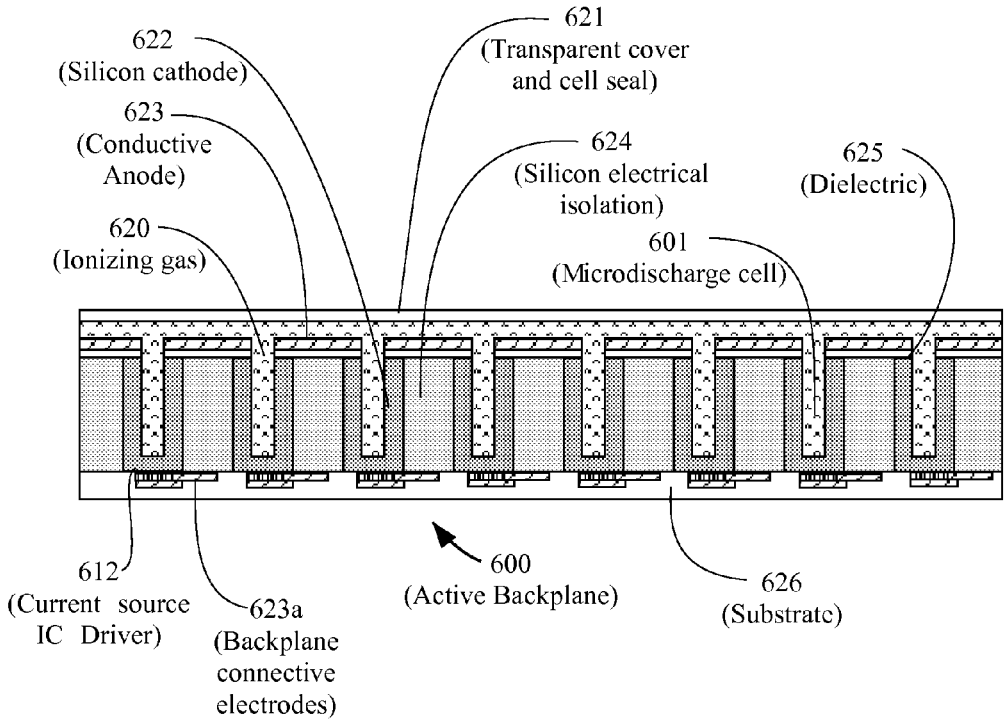
FIG. 6A is a Section 6A-6A View of an open cell structure microdischarge antenna device built on a silicon substrate containing an active backplane.

FIG. 6A is a Section 6A-6A View of an open cell structure microdischarge antenna device built on a silicon substrate 626 containing an active backplane 600. A matrix of electrically isolated conductive hollow silicon cathodes cells 622 are contained within an electrically isolating silicon 624, and isolated from conductive anodes 623 by dielectric layer 625. The hollow cavities in the silicon substrate 626 are covered and sealed by transparent cover and seal 621, which seals the silicon cathodes so as to form a matrix of open microdischarge cavities containing mixtures of ionizing gas. An active matrix of electrical driver circuits 612 on the reverse side of the substrate 626 make contact with a conductive portion of the each microdischarge cathode 622, and are connected to backplane connective electrodes 623*a*. Electrodes 623*a* are, in turn, connected to appropriate voltage and control as illustrated in schematics.

Figure 7:
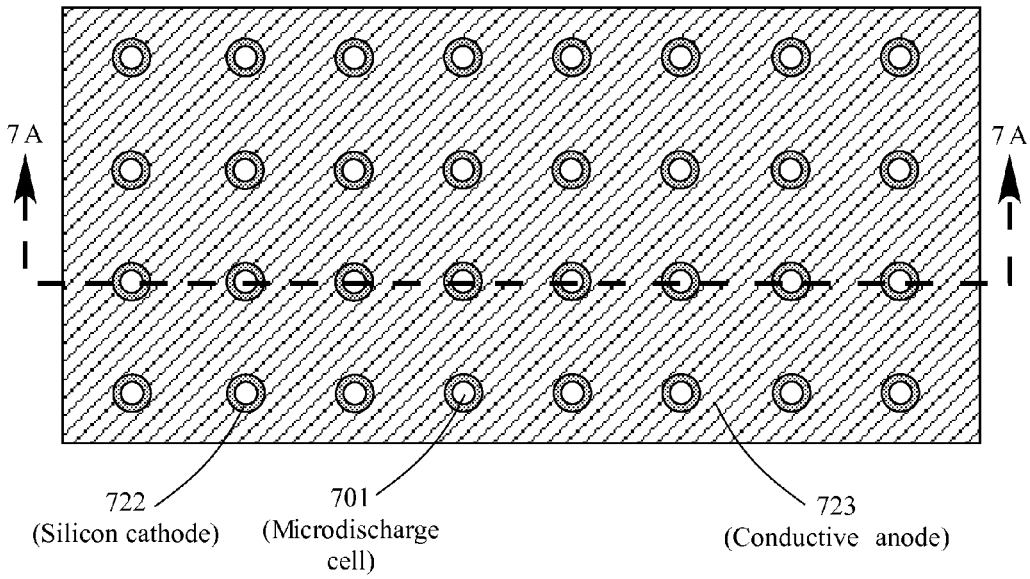
FIG. 7 is a front view of an open cell structure microdischarge antenna device with a transparent cover removed.

FIG. 7 is a front view of an open cell structure microdischarge antenna device with a transparent cover and seal, and dielectric removed revealing a conductive anode 723, silicon cathode 722, and microdischarge cells 701.

Figure 7A:
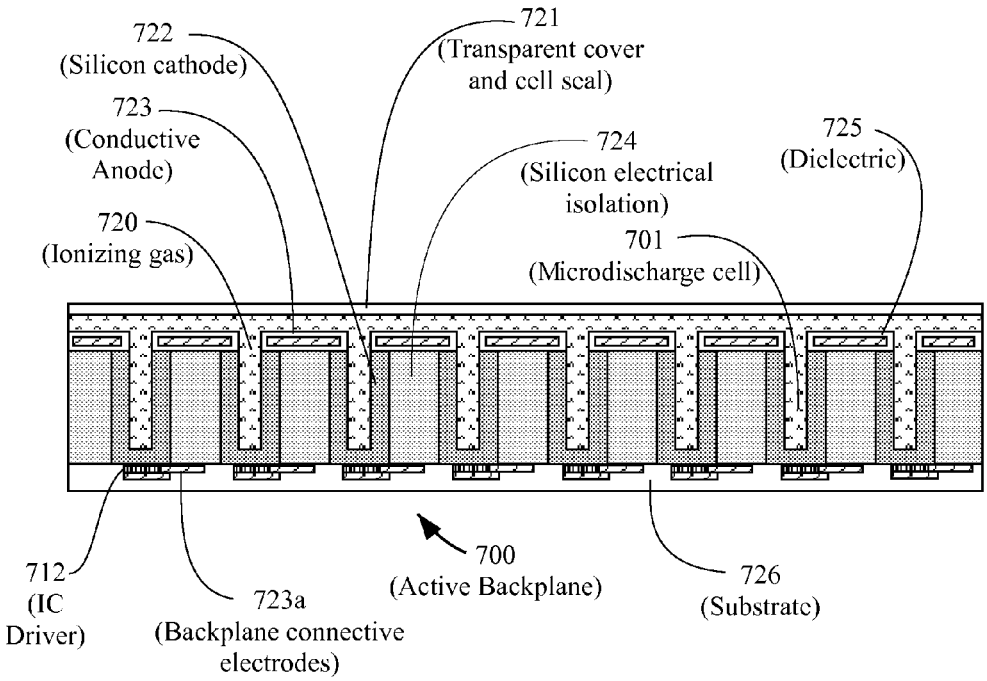
FIG. 7A is a Section 7A-7A View of an open cell structure microdischarge antenna device built on a silicon substrate containing an active backplane.

FIG. 7A is a Section 7A-7A View of an open cell structure microdischarge antenna device built on a silicon substrate 726 containing an active backplane 700. A matrix of electrically isolated conductive hollow silicon cathodes cells 722 are contained within an electrically isolating silicon 724, and isolated from conductive anodes 723 by dielectric layer 725. The hollow cavities in the silicon substrate are covered and sealed by transparent cover and seal 721, which seals the silicon cathodes so as to form a matrix of open microdischarge cavities containing mixtures of ionizing gas 720. An active matrix of electrical driver circuits 712 on the reverse side of the substrate 726 make contact with a conductive portion of the each microdischarge cathode 722, and are connected to backplane connective electrodes 723*a*. Electrodes 723*a* are, in turn, connected to appropriate voltage and control as illustrated in schematics.

Figure 8:
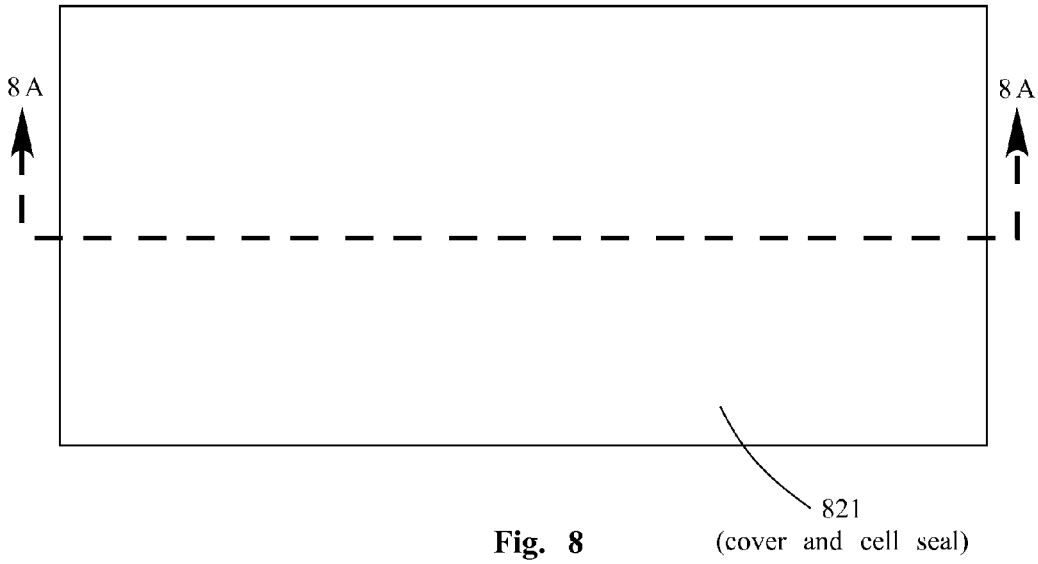
FIG. 8 is a front view of a closed cell structure microdischarge antenna device with a transparent cover and seal.

FIG. 8 is a front view of a closed cell structure microdischarge antenna device with a transparent cover 821.

Figure 8A:
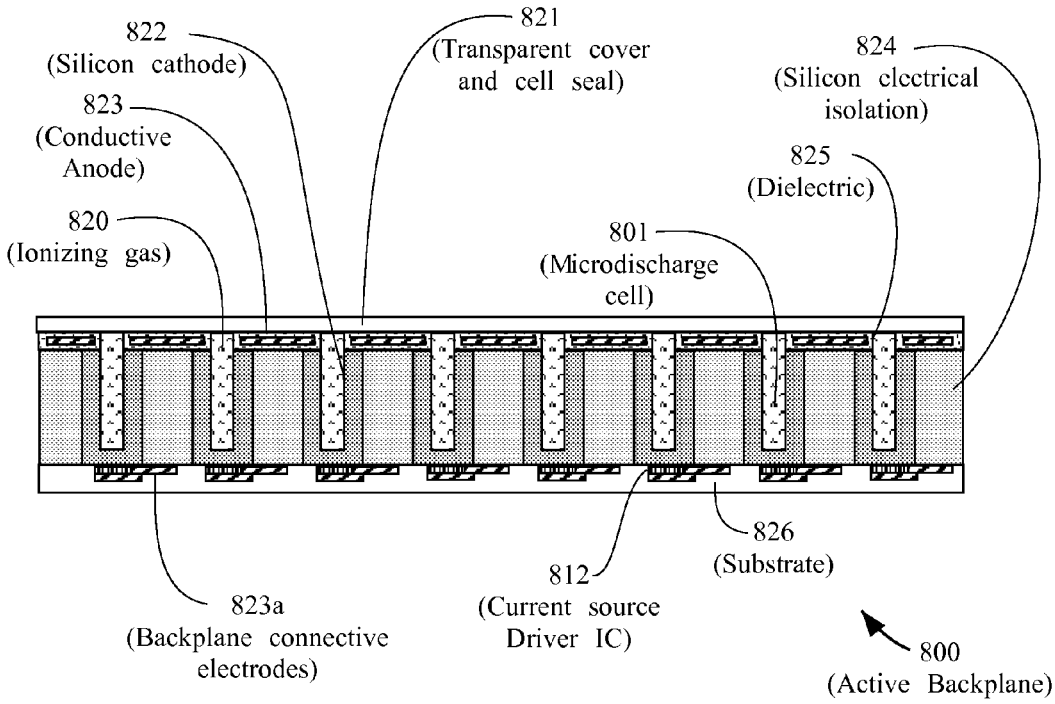
FIG. 8A is a Section 8A-8A View of a closed cell structure microdischarge antenna device built on a silicon substrate containing an active backplane.

FIG. 8A is a Section 8A-8A View of a closed cell structure microdischarge antenna device built on a silicon substrate 826 containing an active backplane 800 and microdischarge cells 801. A matrix of electrically isolated conductive hollow silicon cathode cells 822 are contained within an electrically isolating silicon 824, and isolated from conductive anodes 823 by dielectric layer 825. The hollow cavities in the silicon substrate 826 are covered and sealed by transparent cover 821 which seals the silicon cathodes 822 so as to form a matrix of closed microdischarge cavities containing mixtures of ionizing gas 820. An active matrix of electrical driver circuits 812 on the reverse side of the substrate 826 make contact with a conductive portion of the each microdischarge cathode 823, and are connected to backplane connective electrodes 823*a*. Electrodes 823*a* are, in turn, connected to appropriate voltage and control as illustrated in schematics.

Figure 9A:
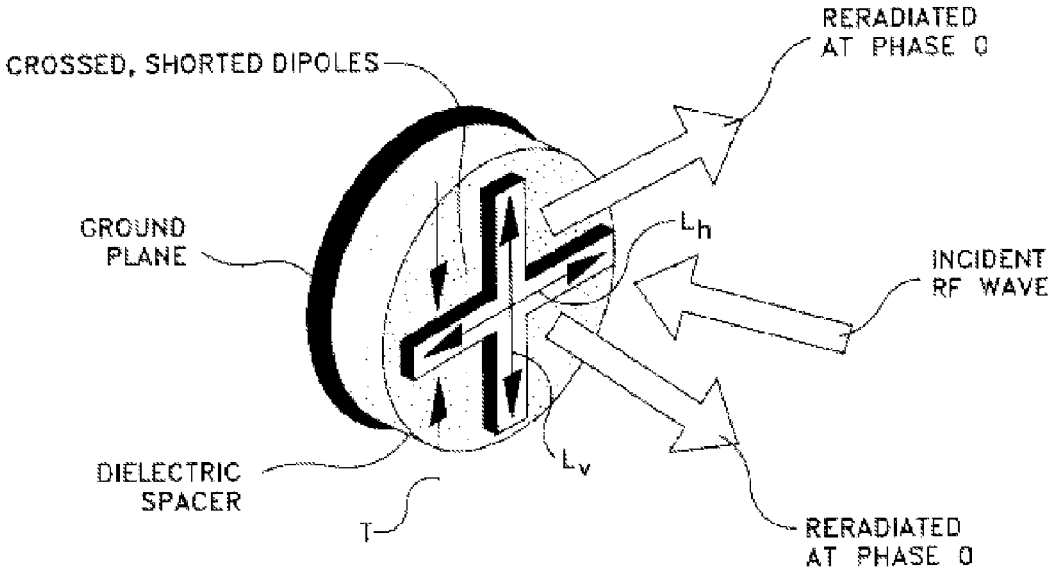
Fig. 9A Prior Art
FIG. 9A is a prior art perspective view of a conventional radiating element.
Figure 9B:
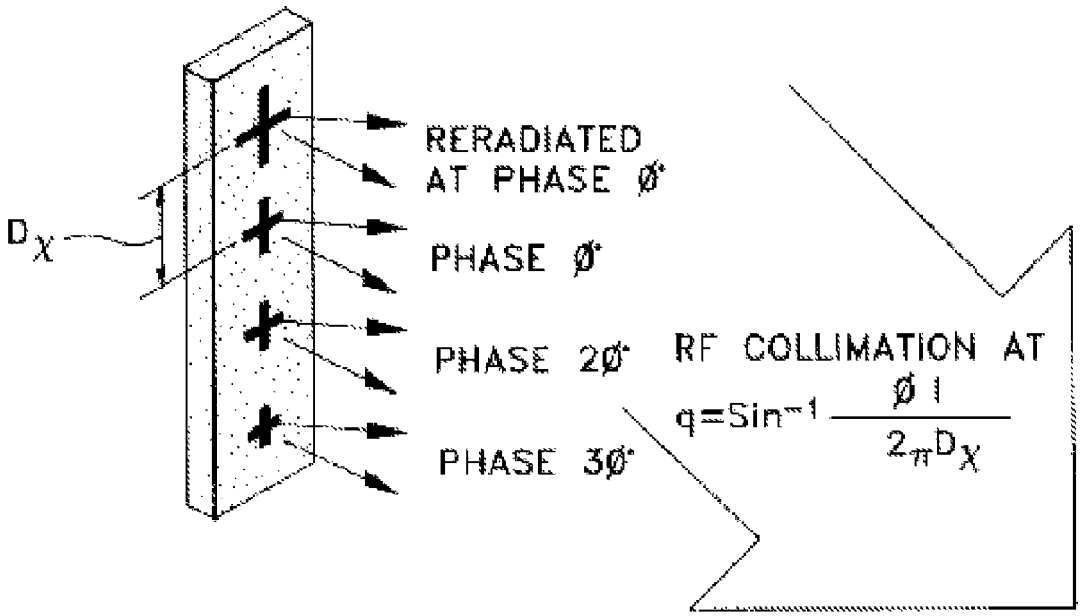
Fig. 9B Prior Art
FIG. 9B is a prior art perspective view of one form of a conventional phased array antenna.
Figure 9C:
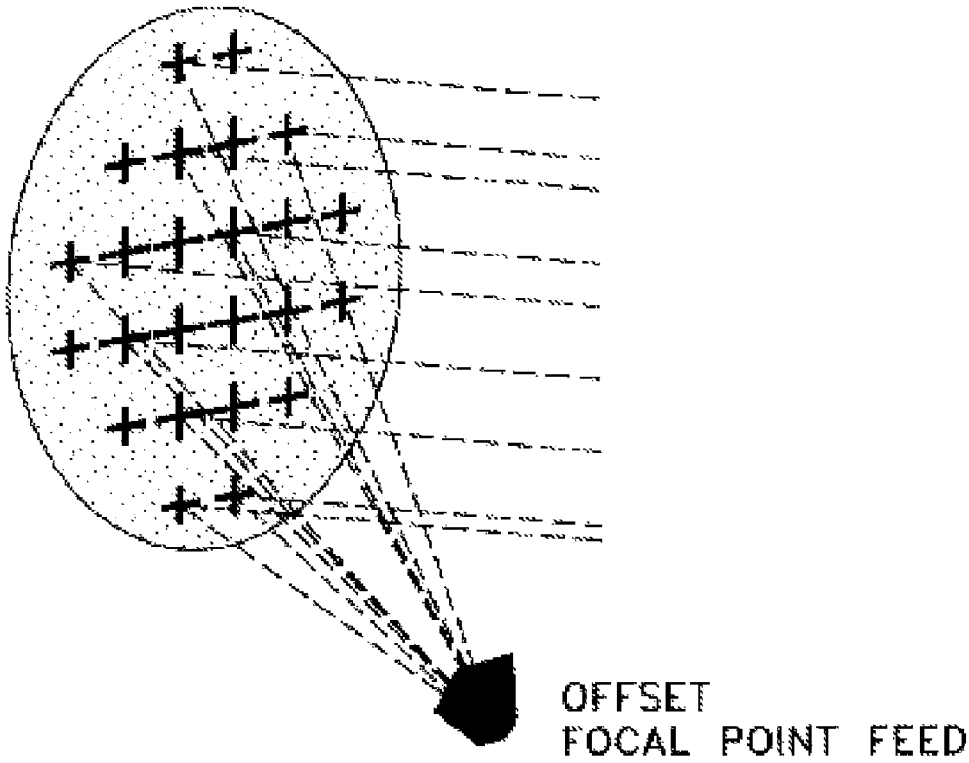
Fig. 9C Prior Art
FIG. 9C is a prior art perspective view of one form of a phased array antenna.
Figure 9D:
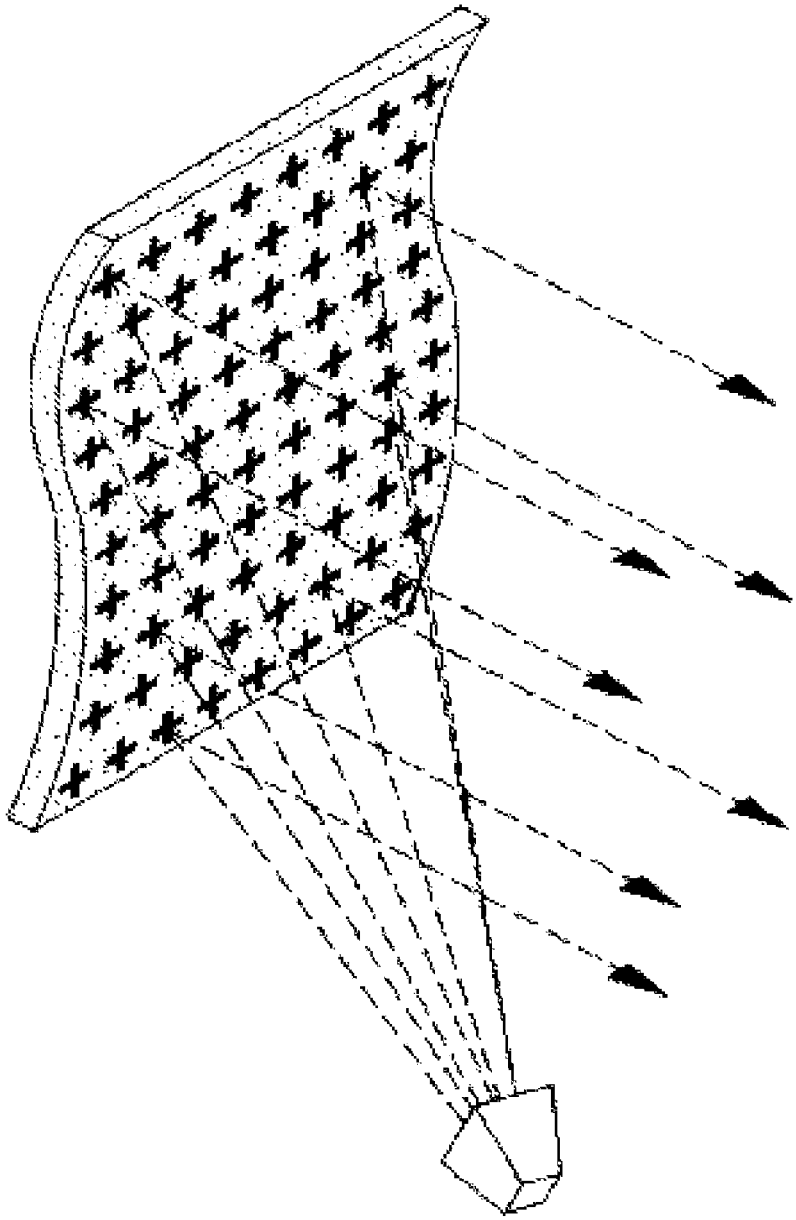
Fig. 9D Prior Art
FIG. 9D is a prior art perspective view of a conformal form of a phased array antenna.

FIG. 9A is an exemplary embodiment of an electromagnetically loading structure formed in accordance with the technology as disclosed in the prior art, for example Gonzalez et al. (014) and arrays thereof as shown in FIGS. 9B through 9D. The basic elemental structure, as shown in FIG. 9A, is a crossed shorted dipole situated over a ground plane with an intermediate dielectric material sandwiched there between. It is to be appreciated that each arm of the crossed dipole independently controls its corresponding polarization. Incident RF (radio frequency) energy causes a voltage standing wave to be set up between the dipole and the ground plane. The dipole itself possesses an RF reactance, which is a function of the size of the dipole. This combination of the formation of a voltage standing wave and the dipole reactance causes the incident RF energy to be reradiated with a phase shift $\phi$.

The exact value of this phase shift $\phi$ is a complex function of the dipole length and thickness, the distance between the dipole and the ground plane, the dielectric constant associated with the dielectric spacer and the angle associated with the incident RF energy. When used in an array, as shown in FIGS. 9B through 9D, the phase shift $\phi$ associated with a dipole is also affected by nearby dipoles.

In practice, the dipole arm lengths may be within the approximate range of one-quarter (¼) to one-sixteenth (1/16) of the wavelength of the operating frequency of the incident RF energy in order to provide a full range of phase shifts. The preferred spacing between a dipole and the ground plane is between approximately one-sixteenth (1/16) and one-eighth (⅛) of the wavelength associated with the incident RF energy wave. It is to be appreciated that the dipole/ground plane spacing also affects certain parameters of the phased array antenna, such as form factor, bandwidth, and sensitivity to fabrication errors. The dipole structure in FIG. 9A is typically formed by the etching of a printed circuit board. At longer wavelengths (i.e., lower incident RF energy operating frequencies), plating of a dielectric fiber strand is an alternate dipole fabrication method. It is to be appreciated that a radiating element formed in accordance with this technology may operate at frequencies in the microwave and millimeter wave range.

As shown in FIG. 9B, each radiating element functions in a similar manner as a static phase shifter in a phased array antenna. Specifically, if a plurality of such radiating elements are designed to reradiate incident RF energy with a progressive series of phase shift $\phi$, $2\phi$, $3\phi$ . . . $n\phi$, then a resultant RF beam is formed in the direction $\theta$, which may be represented as:

$$\theta = \sin - 1\frac{\phi\lambda}{2\pi d_x}L \qquad \text{Eq. (1)}$$

Where $d_x$ represents the spacing between radiating elements, $\lambda$ represents the wavelength of the incident RF energy and Ø represents the element-to-element phase shift, i.e., the phase gradient.

Equation (1) is for beam steering in a single plane. Just as in two-dimensional phased array antennas, beam steering can be accomplished in both azimuth and elevation by application of phase gradients among the dipole radiating elements in both the x and y planes. In such case, the beam scan equation is dependent upon both the x and y spacing of the elements. It is to be appreciated that while the angle θ is referred to as the scan angle, the phased array formed by the radiating elements described in Gonzalez et al. (014) performs beam steering and focusing only, that is, the incident RF energy is reradiated in a single direction θ, depending on the formation of the radiating elements, and does not perform an electronic scanning function.

While the embodiment illustrated in FIG. 9A shows a zero degree angle of incident RF energy, the incident RF wave may, in fact, be at any angle up to approximately 70 degrees. When such is the case, the angle of scattered energy, θ may be more generally represented as:

$$\theta = \sin^{-1}\frac{\phi\lambda}{2\pi d_x} - \sin\theta_0$$

where $\theta_o$ is the angle of incidence and θ is the beam energy scattering angle. Note that if:

$$\phi = \frac{4\pi d_x \sin\theta_0}{\lambda}$$

then the RF energy is returned in the direction from which it came even though the surface containing the radiating elements is at a tilted angle.

The phased array described in the context of FIG. 9B is considered to perform uniform radiation beam steering. However, this concept may be extended to the situation in which either the steering angle θ or the angle of incidence $\theta_o$, or both, are adjusted over the surface of the phased array of radiating elements. Such an approach, which utilizes a flat collimating surface, is illustrated in FIG. 9C. In the approach shown in FIG. 9C, the steering angle developed by the phase shifts of each radiating element is set in order to cause all incident energy to be focused on a feed. In this manner, the phased array functions as a parabolic reflector, but in a flat surface configuration. As shown in FIG. 9C, the RF energy is both focused and steered toward an offset feed. Using the above-described local steering properties further allows the surface to be conformed to any reasonably smooth shape. Such a conformal phased array is illustrated in FIG. 9D.

While the above-described phased array antennas technology disclosed in Gonzalez et al. (014) permit emulation of reflective surfaces and focusing elements of selected geometry, the individual radiating elements, e.g., dipoles, cannot be dynamically reconfigured. Due to the lack of dynamic reconfigurability of the dipoles, the above-described phased array antennas are incapable of dynamically varying the phase shifts associated with the dipoles and, therefore, such antennas cannot perform electronic scanning functions.

Dynamically Reconfigured Phased Array Antennas Using Gas Plasma Technology

Dynamically reconfigurable antennas are known in the prior art. U.S. Pat. No. 5,864,322 (Pollon) is an example of a dynamically reconfigurable phased array antenna using gas plasma. Pollon (322) incorporates plasma technology whereby the radiating elements, e.g., dipoles, are dynamically configured (and reconfigured) such that the antenna may advantageously perform electronic scanning functions. The electronic scan antenna of the present invention includes at least one plasma structure. In one embodiment, the plasma structure has an electrode matrix formed by the intersection of one or a plurality of parallel vertical wire electrodes and one or a plurality of parallel horizontal wire electrodes. The vertical and horizontal electrodes are preferably orthogonal to each other and are electrically isolated from each other. Each intersection of a vertical and horizontal electrode defines a pixel. Each pixel may be defined by a unique (x,y) coordinate. A noble gas mixture (e.g., neon and xenon) is contained within the structure and in electrical communication with the electrode matrix. The electronic scan antenna also preferably includes control circuitry for controlling the activation of each pixel. Further, the electronic scan antenna of the present invention includes reflective means, e.g., a metal ground plane, for reflecting incident RF energy waves in the operating frequency range. In Pollon (322), different pixels may be excited by the control circuitry such that the plasma contained within the vicinity of the pixel becomes substantially RF conductive and thus, advantageously behaves like a reflecting element. Various pixels may be simultaneously excited in order to form reflecting elements having a variety of shapes and sizes. For example, gas-containing areas may be excited to form ionized plasma areas, which, in turn, form reflecting elements in the shape of dipoles. Accordingly, each plasma-reflecting element, in cooperation with the ground plane, reflects a portion of an incident RF wave and imparts a phase shift on the reflected wave causing the reflected wave to radiate in a direction θ.

As noted above, the adjustment of certain parameters associated with a dipole, e.g., length of dipole, affect the nature of the phase shift imparted. However, with respect to the prior art approach taught in Gonzalez et al. (014) once a dipole is etched into a printed circuit board, the parameters of the dipole such as dipole length cannot be dynamically changed. Thus, the phase shift imparted by the particular dipole is fixed, i.e., cannot be dynamically varied.

Because individual pixels may be selectively excited, the parameters associated with the radiating elements formed therewith may be advantageously reconfigured in a dynamic manner. In this way, the phase shift imparted by any particular dipole may be dynamically varied by varying the length, for example, of the dipole formed by the pixels of the plasma structure. Thus, a phased array antenna capable of radiating an electronically scanned RF beam may be formed by coordinating the dynamic variation of the parameters of each dipole (e.g., length).

The plasma technology provides a unique phasing structure for electromagnetically emulating a desired reflective surface of selected geometry over at least one operating frequency band or range. Such a novel phasing structure includes reflective means (i.e., ground plane) for reflecting energy of an incident RF beam within the at least one frequency band or range. The phasing structure also includes a phasing arrangement of at least one plasma structure which is operatively coupled to the reflective means whereby the plasma structure includes at least one gas containing area (i.e., the area in the immediate vicinity of a pixel) which is reflective at the one operating frequency range when ionized. Such a gas containing area forms an ionized plasma area, which is disposed a distance from the reflective means and has a particular size associated therewith. In this manner, the phasing structure generates a reflected RF beam with a phase shift imparted thereon, in response to the incident RF beam, so as to provide the emulation of the desired reflective surface of selected geometry. Preferably, the phasing structure further includes a control circuit for dynamically varying the size of the at least one ionized plasma area so that the phase shift imparted on the reflected RF beam dynamically varies so that the reflected RF beam is electronically scanned.

Figure 10A:
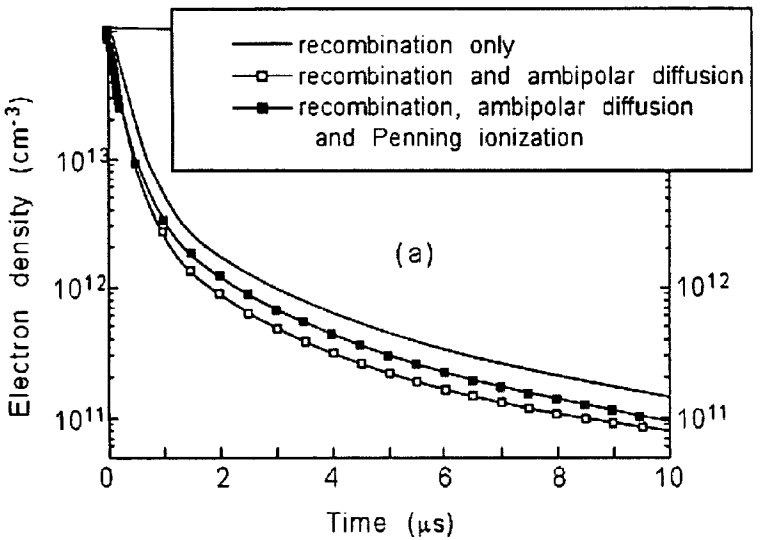
FIG. 10A is a graph of Electron Density vs. Time in a plasma antenna device.
Figure 10B:
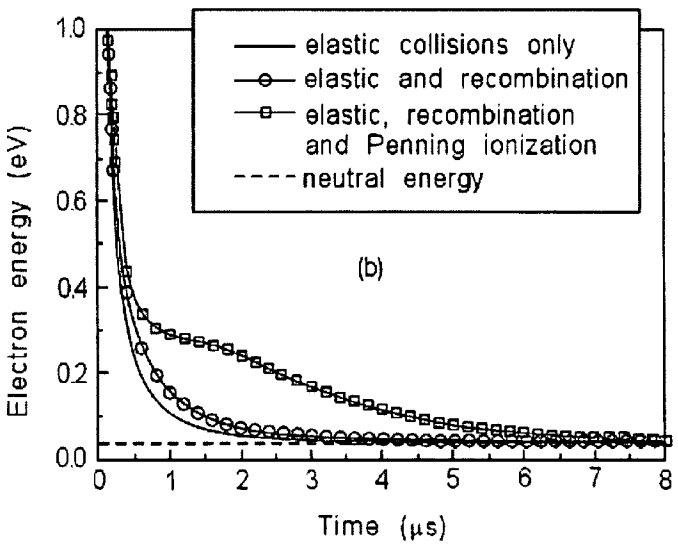
FIG. 10B is a graph of Electron Energy vs. Time in a plasma antenna device.
Figure 10C:
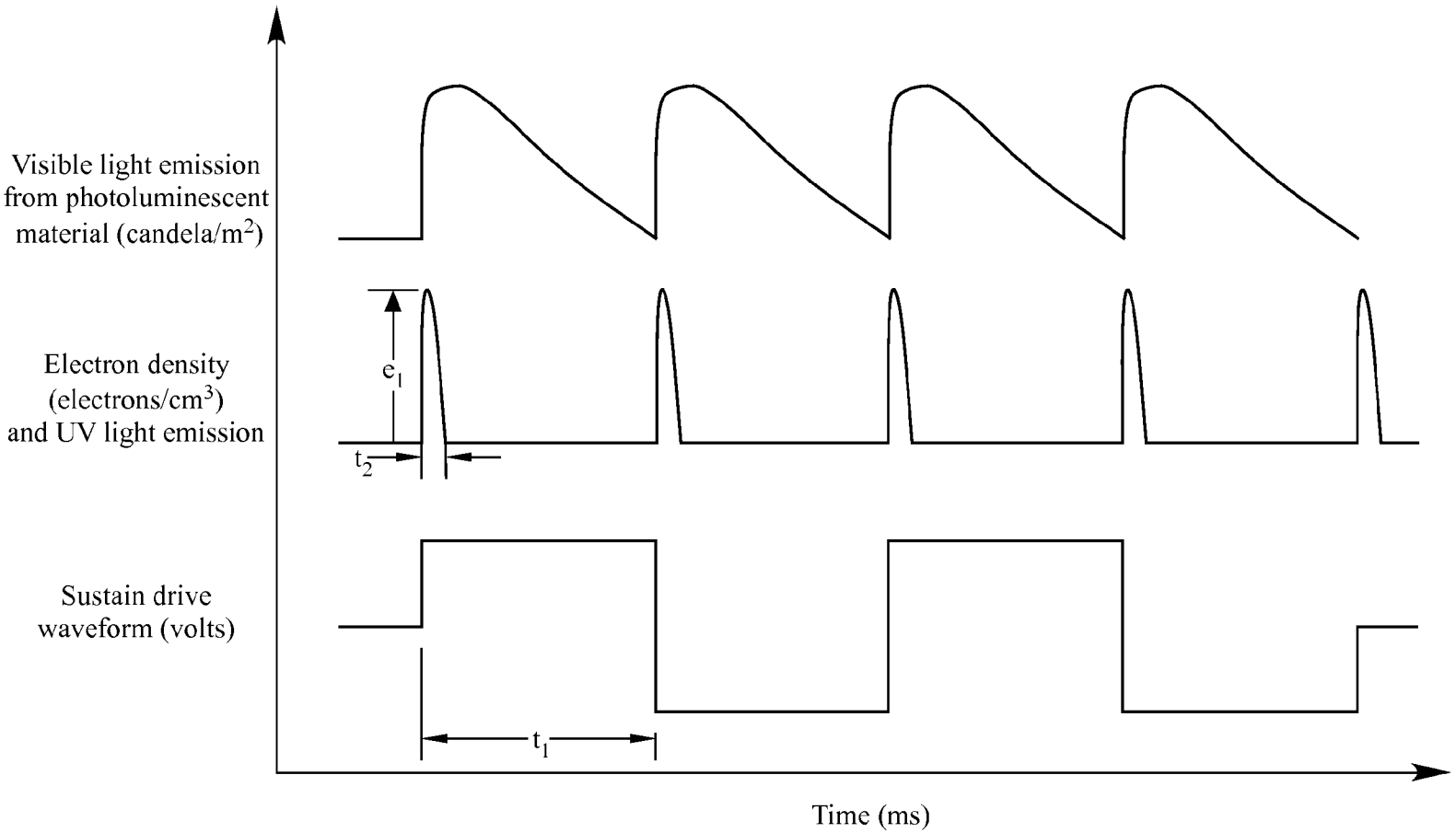
FIG. 10C is a discharge Electron Density graph vs. Time diagram.

Although a sustain voltage is sufficient to maintain the firing of the plasma, the electron density is not uniform. FIGS. 10A, 10B, and 10C show the electron density fluctuates by several orders of magnitude in several microseconds. Further, the electron energy also decays very rapidly within 100 ns. This fluctuation will not allow accurate dynamic control of the antenna.

FIG. 10C is a discharge electron density graph-timing diagram showing the timing relationships of a typical gas discharge plasma antenna device. Each plasma antenna device pixel acts as a capacitor producing a brief intense discharge (with an electron density of $10^{14}$ $cm^3$ nominally on the order of 200 nanoseconds ($t_2$) with every sustain cycle. The gas discharge sustain cycles occur nominally and are produced every 6000 nanoseconds; meaning that while the discharge appears to be continuous (i.e., the phosphor may decay over the sustain cycle time); the electron density that effects the RF phase delay (through reflection and/or refractive interaction with the RF wave) is not present. Operation in a radar environment requires a continuous electron density on the order of $10^{14}$ $cm^3$ to function in both transmit and receive modes. Consequently, conventional gas discharge devices will not support radar phase delay operation.

In order to overcome the limitations imposed by the very short duration of the high electron density pulse (200 nanoseconds), the device may use, a radio frequency (RF) voltage signal of one to several hundred MHz to cause a antenna device discharge, i.e., a sustain discharge. In this case, since electrons perform a vibration motion (or a swing motion), there is maintained an antenna device discharge while the radio frequency voltage signal is applied. In detail, if the radio frequency voltage signal, having alternating voltage polarities, is applied to any one of two electrodes opposed to each other, charged particles move toward one electrode or another electrode according to the polarity of the radio frequency voltage signal. Furthermore, the polarity of the radio frequency voltage signal is already inverted before a charged particle, in the discharge space moving toward the one of the electrodes, actually arrives at the electrode. The voltage inversion reverses the attractive force and direction of travel on the particle to the opposite electrode, before it is terminated at the first electrode. The process is repeated for each radio frequency cycle maintaining the oscillation pattern of the charged particles, and maintaining a constant high electron density within the discharge space. The charged particle in the discharging space swings between the two electrodes because the polarity of the radio frequency voltage signal is changed before the charged particle has arrived at any one of two electrodes. Therefore, during the supplying period of the radio frequency voltage signal, the charged particles do not extinguish and the excitation and transition of gaseous particles is continuously generated. Because the antenna device discharge is maintained during a greater part of a set discharge period, the discharging efficiency is enhanced. Radio frequency voltage signal augmentation for gas discharge devices are described in U.S. Pat. Nos. 6,624,799, 6,661,394, 6,605,897, 6,501,447, 6,483,489, 6,476,562, 6,473,061, 6,340,866, 6,271,810, and 6,794,820 all listed above and incorporated herein by reference.

The RF may especially be used to sustain the plasma discharge. RF may also be used to operate the plasma microcavities with a positive column discharge. The use of RF in a gas discharge device is disclosed in U.S. Patent Nos. 6,271,810 (Yoo et al.), 6,340,866 (Yoo), 6,473,061 (Lim et al.), 6,476,562 (Yoo et al.), 6,483,489 (Yoo et al.), 6,501,447 (Kang et al.), 6,605,897 (Yoo), 6,624,799 (Kang et al.), 6,661,394 (Choi), and 6,794,820 (Kang et al.), all incorporated herein by reference.

Ionizable Gas

The microcavity as used in the practice of this invention contains one or more ionizable gas components that generate free electrons. As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof. Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129, and isotopes of oxygen such as oxygen-18. Other isotopes include deuterated gases such as deuterated ammonia ($ND_3$) and deuterated silane ($SiD_4$).

In one embodiment, a two-component gas mixture (or composition) is used. Such mixtures include argon and xenon, argon and helium, xenon and helium, neon and argon, argon and krypton, neon and xenon, neon and helium, neon and krypton, xenon and krypton, and helium and krypton. Specific two-component gas mixtures (compositions) include about 5% to 90% atoms of argon with the balance xenon. Another two-component gas mixture is a mother gas of neon containing 0.05% to 15% atoms of xenon, argon, or krypton. This can also be a three-component gas, four-component gas, or five-component gas by using quantities of an additional gas or gases selected from xenon, argon, krypton, and/or helium. In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon, krypton-neon-xenon, and krypton-helium-xenon.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton. In one embodiment, there is used a high concentration of helium with the balance selected from one or more gases of neon, argon, xenon, and nitrogen as disclosed in U.S. Pat. No. 6,285,129 (Park) and incorporated herein by reference.

A high concentration of xenon may also be used with one or more other gases as disclosed in U.S. Pat. No. 5,770,921 (Aoki et al.), incorporated herein by reference. Pure neon may be used and the Plasma microcavities operated without memory margin using the architecture disclosed by U.S. Pat. No. 3,958,151 (Yano) discussed above and incorporated herein by reference.

Excimers

Ionizable excimer gases that generate free electrons may also be used as disclosed in U.S. Pat. Nos. 4,549,109 (Nighan et al.) and 4,703,229 (Nighan et al.), both incorporated herein by reference. Nighan et al. (109) and (229) disclose the use of excimer gases formed by the combination of halogens with rare gases. The halogens include fluorine, chlorine, bromine, and iodine. The rare gases include helium, xenon, argon, neon, krypton, and radon. U.S. Pat. No. 6,628,088 (Kim et al.), incorporated herein by reference, also discloses excimer gases.

Other Gases

A wide variety of other ionizable gases that generate free electrons are contemplated for the practice of this invention. Such other gases include $C_2H_2$—$CF_4$—Ar mixtures as disclosed in U.S. Pat. Nos. 4,201,692 (Christophorou et al.) and 4,309,307 (Christophorou et al.), both incorporated herein by reference. Also contemplated are gases disclosed in U.S. Pat. No. 4,553,062 (Ballon et al.), incorporated by reference. Other gases include sulfur hexafluoride, HF, $H_2S$, $SO_2$, SO, $H_2O_2$, and so forth.

Gas Pressure

This invention allows the construction and operation of a microdischarge antenna device with gas pressures at or above 1 atmosphere. In the prior art, gas discharge devices are operated with the ionizable gas at a pressure below atmospheric. Gas pressures above atmospheric are not used in the prior art because of structural problems. Higher gas pressures above atmospheric may cause the device substrates to separate, especially at elevations of 4000 feet or more above sea level. In the practice of this invention, the gas pressure inside of a closed cell hollow plasma microcavity device may be equal to or less than atmospheric pressure or may be equal to or greater than atmospheric pressure. The typical sub-atmospheric pressure is about 150 to 760 Torr. However, pressures above atmospheric may be used depending upon the structural integrity of the plasma microcavity. In one embodiment of this invention, the gas pressure inside of a closed or open cell plasma microcavity device is equal to or less than atmospheric, about 150 to 760 Torr, typically about 350 to about 650 Torr. In another embodiment, the gas pressure inside a closed cell plasma microcavity device is equal to or greater than atmospheric. Depending upon the structural strength of the plasma microcavity closed cell device, the pressure above atmospheric may be about 1 to 250 atmospheres (760 to 190,000 Torr) or greater.

SUMMARY

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A radio frequency phasing system for electromagnetically emulating a desired reflective surface of selected geometry over at least one operating frequency range, which comprises:

a reflective means for reflecting energy of an incident radio frequency beam within the at least one frequency range;

a phasing arrangement of at least one microdischarge structure that is operatively coupled to the reflective means, the at least one microdischarge structure including at least one microcavity plasma cell containing ionizable gas, said cell being reflective at the at least one operating frequency range when the gas is ionized, the ionized gas within the microcavity being disposed at a distance from said reflective means and having a size associated therewith whereby the phasing structure generates a reflected radio frequency beam with a phase shift imparted thereon in response to the incident radio frequency beam so as to provide an electromagnetic emulation of a desired reflective surface of selected geometry; said phasing arrangement further including a second ionized plasma cell being disposed a first distance from said reflective means and a second distance from the at least one ionized plasma cell and having a size associated therewith whereby the at least one ionized plasma cell and second ionized plasma cell impart a composite phase shift on the reflected radio frequency beam formed from a combination of the individual phase shifts provided by each plasma cell; and control circuitry for dynamically varying the size of the at least one ionized cell such that the phase shift imparted on the reflected radio frequency beam dynamically varies so that the reflected radio frequency beam is electronically scanned.

2. A radio frequency phasing system as defined in claim 1 wherein the at least one ionized plasma cell forms a radiating element in the form of a dipole.

3. A radio frequency phasing system as defined in claim 2 wherein the control circuitry dynamically varies a length of the dipole in order to dynamically vary the phase shift imparted on the reflected radio frequency beam.

4. A radio frequency phasing system as defined in claim 2 wherein the position, length, and/or spacing of the dipole is selected to efficiently reflect incident radiation at a desired angle.

5. A radio frequency phasing system as defined in claim 1 wherein said control circuitry provides high frequency to each microcavity plasma cell, said frequency ranging from about 1 megahertz to about 100 megahertz.

6. A radio frequency phasing system as defined in claim 1 wherein a plurality of microcavity plasma cells are located on a single substrate.

7. A radio frequency phasing system as defined in claim 1 wherein a multiplicity of substrates are tiled together to form a larger array.

8. A radio frequency phasing system as defined in claim 1 further including a second reflective means disposed a distance from the ionized area cell for reflecting energy of an incident radio frequency beam within a second operating frequency range.

9. A radio frequency phasing system as defined in claim 1 wherein the at least one microdischarge structure has a planar geometry.

10. A radio frequency phasing system as defined in claim 1 wherein the desired reflective surface is a parabolic reflector.

* * * * *